US010033134B2

(12) United States Patent
Tucker

(10) Patent No.: US 10,033,134 B2
(45) Date of Patent: Jul. 24, 2018

(54) CONNECTOR PART OF A SUBSEA CONNECTOR

(71) Applicant: Siemens Aktiengesellschaft, Munich (DE)

(72) Inventor: David Michael Tucker, Millom (GB)

(73) Assignee: Siemens Aktiengesellschaft, Munich (DE)

( * ) Notice: Subject to any disclaimer, the term of this patent is extended or adjusted under 35 U.S.C. 154(b) by 7 days.

(21) Appl. No.: 15/344,806

(22) Filed: Nov. 7, 2016

(65) Prior Publication Data

US 2017/0141507 A1 May 18, 2017

(30) Foreign Application Priority Data

Nov. 16, 2015 (EP) ..... 15194717

(51) Int. Cl.

| | |
|---|---|
| ***H01R 4/60*** | (2006.01) |
| ***H01R 4/64*** | (2006.01) |
| ***H01R 13/523*** | (2006.01) |
| ***H01R 13/453*** | (2006.01) |
| ***H01R 13/15*** | (2006.01) |
| *H01R 39/56* | (2006.01) |

(52) U.S. Cl.
CPC ..... *H01R 13/523* (2013.01); *H01R 13/15* (2013.01); *H01R 13/4538* (2013.01); *H01R 39/56* (2013.01)

(58) Field of Classification Search
CPC ..... H01R 13/523; H01R 39/56
USPC ..... 439/190, 191, 201
See application file for complete search history.

(56) References Cited

U.S. PATENT DOCUMENTS

| | | | | |
|---|---|---|---|---|
| 6,464,405 | B2 * | 10/2002 | Cairns | G02B 6/3816 385/139 |
| 6,659,780 | B2 | 12/2003 | Parkinson et al. | |
| 6,929,404 | B2 | 8/2005 | Jones et al. | |
| 7,866,993 | B2 * | 1/2011 | Ohsumi | H01R 12/721 439/141 |

(Continued)

FOREIGN PATENT DOCUMENTS

| | | |
|---|---|---|
| EP | 2520757 A2 | 11/2012 |
| EP | 2853679 A1 | 4/2015 |
| GB | 2402560 A | 12/2004 |

OTHER PUBLICATIONS

EP Search Report dated May 2, 2016, for EP application No. 15194717.3.

*Primary Examiner* — Tho D Ta
*Assistant Examiner* — Thang Nguyen
(74) *Attorney, Agent, or Firm* — Beusse Wolter Sanks & Maire

(57) ABSTRACT

A connector part of a subsea connector, in particular an ROV mateable subsea connector, adapted to be mated with a second part of the subsea connector. The connector part includes at least a first contact configured for engagement with a respective second contact of the second connector part for establishing a connection. The connector part has a damper unit. At least the first contact is mounted to the damper unit. The damper unit is configured to be activated by an engagement of the connector part with the second connector part and is further configured to delay the engagement of the first contact with the second contact of the second connector part during the engagement of the connector part with the second connector part.

17 Claims, 6 Drawing Sheets

(56) References Cited

U.S. PATENT DOCUMENTS

| | | | | |
|---|---|---|---|---|
| 7,959,454 | B2 * | 6/2011 | Ramasubramanian | H01R 13/03 439/201 |
| 8,641,446 | B1 * | 2/2014 | Chen | H01R 24/52 439/141 |
| 9,343,846 | B2 * | 5/2016 | Burrow | H01R 13/523 |
| 2004/0266240 | A1 * | 12/2004 | Abbey | H01R 13/523 439/201 |
| 2012/0279718 | A1 * | 11/2012 | Rocke | E21B 17/028 166/341 |
| 2013/0034982 | A1 * | 2/2013 | Linder | H01R 13/187 439/271 |
| 2014/0094051 | A1 * | 4/2014 | Mckay | H01R 13/523 439/345 |
| 2014/0370735 | A1 * | 12/2014 | Nicholson | H01R 13/523 439/271 |
| 2017/0093083 | A1 * | 3/2017 | Chana | H01R 13/523 |

* cited by examiner

CONNECTOR PART OF A SUBSEA CONNECTOR

CROSS REFERENCE TO RELATED APPLICATIONS

This application claims the benefit of European Application No. EP15194717 filed 16 Nov. 2015, incorporated by reference herein in its entirety.

FIELD OF THE INVENTION

The present invention relates to a connector part of a subsea connector, in particular of an ROV mateable subsea connector, and to a method of providing a connection in a subsea environment.

BACKGROUND

Several applications are known in which connections need to be provided underwater, such as electrical connections and/or optical connections. Examples include a subsea installation for the production of hydrocarbons from a subsea well, in which different components of the subsea installation may need to be connected for power transfer and/or data communication. Such connections may for example comprise a connection from a topside installation, such as a floating or fixed platform, or from an onshore site, to a subsea component, for example by means of an umbilical or a subsea cable. Other connections include electrical connections between different type of subsea equipment, such as a connection between a subsea transformer and subsea switchgear, a data connection between different control modules or between a hub and a satellite well. In some configurations, a data connection may need to be provided over increased distances, for example between two subsea wells that are more than 1 km apart, for which purpose an optical data connection is particularly beneficial, in particular when making use of an Ethernet data connection.

For providing an underwater connection, wet-mateable connectors are known which can be mated underwater. Although such type of connectors are generally more complex than corresponding dry-mate connectors, which have to be mated above the water surface, wet-mateable connectors have several advantages. Components of the subsea installation can for example be disconnected and can be retrieved for servicing or exchange, additional components may be connected to an existing subsea installation, connections can be provided to a subsea structure after installation thereof at the ocean floor, and the like.

When establishing a connection subsea, a first connector part, for example a plug part, is engaged with a second connector part, for example a receptacle part. Due to the large water depth, this is generally done by making use of a remotely operated vehicle (ROV), which for example holds one connector part and engages it with the other connector part. The ROV is controlled by an ROV pilot located topside, for example onboard of a floating or fixed platform or a vessel. When the first and second connector parts are mated by means of the ROV under control of the ROV pilot, the mating speed and mating angle are generally not well controlled, they largely depend on the skills of the ROV pilot. Subsea wet mateable connectors generally have a rather complex internal structure which is required to protect the interior of the connector and in particular the contacts from the corrosive seawater. By an uncontrolled mating speed that can be created by the ROV during mating, the internal mechanism of the subsea connector becomes vulnerable and may be exposed to excessive dynamic forces. The functionality of the connector may thus be compromised.

It is desirable to improve the reliability of the mating of such connectors subsea, and in particular to prevent damage to the internal components, in particular the contacts, of a subsea connector during the mating procedure.

SUMMARY

Accordingly, there is a need to improve the mating of subsea connectors, and in particular to prevent damage to internal components of a subsea connector during mating.

This need is met by the features of the independent claims. The dependent claims describe embodiments of the invention.

According to an embodiment of the present invention, a connector part of a subsea connector, in particular of an ROV mateable subsea connector is provided. The connector part is adapted to be mated with a second part of the subsea connector. The connector part comprises at least a first contact configured for engagement with a respective second contact of the second connector part for establishing a connection. The connector part further comprises a damper unit, wherein at least the first contact is mounted to the damper unit. The damper unit is configured to be activated by an engagement of the connector part with the second connector part. The damper unit is further configured to delay the engagement of the first contact with the second contact of the second connector part during the engagement of the connector part with the second connector part.

Accordingly, by means of such damper unit, it may become possible to decouple the mating of the first and second connector parts from the engagement of the first contact with the second contact. This way, the engagement of the first contact with the second contact may no longer depend on the ability of the ROV pilot that engages the connector part with the second connector part, so that even if the mating is performed at excessive speed, there can be a reliable and secure engagement of the first contact with the second contact. As a result, excessive dynamic forces on the internal components of the connector part, and in particular damage to the first and/or second contact may be prevented. The performance of the internal engagement process of the first contact with the second contact may thus occur in a controlled way that is controlled by the damper unit, thus negating the detrimental effects of an inadvertent high speed mating performed by the ROV pilot. Furthermore, the damage that may be caused by such high speed mating may first go undetected, since it may not immediately be evident that the damage occurred. If the damage is undetected over a period of time, the damage may propagate and may thus cause latent failure, which can result in a blackout of larger parts of the subsea installation, thus causing excessive costs and efforts for restoring operation of the subsea installation. Such negative effects may be prevented by avoiding damage to the internal components of the connector part.

In particular, the damper unit may be configured such that the mating speed of the connector part with the second connector part may be independent of the engagement speed of the first contact with the second contact. The engagement speed of the first contact with the second contact may in particular be controlled by the damper unit.

In an embodiment, the damper unit is configured to delay the engagement of the first contact with the second contact such that at the point in time when the connector part and the second connector part reach a mated state, the first contact is not yet in engagement with the second contact. In other words, the connection is not yet established. The damper unit is further configured to move the first contact into engagement with the second contact after the connector part and the second connector part have reached the mated state. It should be clear that movement of the first contact towards the second contact can already start before the connector part and the second connector part have reached the mated state, but the engagement and thus the establishing of the connection between the first and second contacts only occurs after the connector part and the second connector part are in the mated state.

The connector part may also be termed a first connector part.

In an embodiment, the damper unit is configured to delay the engagement of the first contact with the second contact with a time constant that is determined by flow of fluid through a restriction, in particular through an aperture. In such configuration, it may be possible to precisely control the engagement speed of the first and second contacts. Furthermore, since a wet mateable connector is generally filled with a fluid, in particular a liquid, the damper unit may make use of such liquid for controlling the delay and/or the engagement speed. The time constant may for example be changed by changing the flow of a fluid, for example by changing the number of apertures and/or changing the size of the aperture (S), by changing the viscosity of the liquid or the like. The aperture may for example be an opening in a chamber, a flow channel or the like. The fluid may be a liquid, in particular a dielectric liquid, such as oil or an ester based fluid.

In an embodiment, the damper unit comprises a moveable element to which the first contact is mounted. The moveable element is moveable between a first position in which the first contact engages the second contact when the connector part and the second connector part are in the mated state, and a second position in which the first contact is spaced apart from the second contact when the connector part and the second connector part are in the mated state. By means of such moveable element, the engagement of the first contact with the second contact may be controlled independently of the mating of the first connector part with the second connector part, since when the connector parts are in the mated state, the moveable element may be moved from the second position into the first position to effect engagement and to establish the connection.

In particular, when the connector part is in an unmated state, the moveable element may be located at the first position. During the engagement of the connector part with the second connector part, the moveable element may be moved into the second position. Accordingly, the first contact may be moved efficiently out of the position in which it would come into contact with the second contact during the mating, so that damage to the first contact and to the second contact can be prevented when the mating occurs to fast.

The movement of the moveable element may be effected by a mating force applied to the connector part or the second connector part during mating. In particular, the movement from the first position to the second position may be achieved by the application of the mating force that is applied by the ROV to one connector part during engagement. In other words, the damper unit is activated by the mating force that is applied to the connector part or the second connector part externally by the ROV.

The movement of the moveable element, in particular the movement from the second position to the first position, may be effected by an elastic force, such as a spring force. Accordingly, the engagement of the first and second contacts no longer depends on the external force applied by the ROV in such configuration.

The damper unit may further more comprise a spring that is mechanically connected to the moveable element so as to urge the moveable element into the first position. The spring can for example be loaded (e.g. compressed or extended) during the mating of the first and second connector parts by the external force when the moveable element is moved from the first position into the second position.

A movement of the moveable element from the second position into the first position may be effected by the spring. The damper unit may be configured such that the movement displaces a liquid at a predetermined rate. The displacement of liquid may damp the movement and thus may delay the engagement of the first contact with the second contact.

In an embodiment, the damper unit comprises a damper body defining a chamber and further comprises a piston providing a wall of the chamber. The piston may be moveable relative to the damper body to change the volume of the chamber. The chamber is filled with a liquid and comprises an opening through which the liquid can enter and escape the chamber. The first contact is mounted to the piston or the damper body. The delay in the engagement of the first contact with the second contact at least partly results from the time required to expel liquid from within the chamber through the opening when moving the damper body relative to the piston. An effective damping system may thus be provided which can effectively control the engagement speed of the first contact with the second contact.

In some embodiments, the above described moveable element may be this damper body. Accordingly, the first contact may be mounted to the damper body and may move together therewith. In other embodiments, the movable element may be the piston, and the first contact may be mounted to the piston and may move together therewith. It should be clear that further configurations of the movable element are conceivable.

The chamber may comprise a spring that applies a force to the piston that pushes the piston in a direction in which the volume of the chamber is increased. Accordingly, in such configuration, when the second connector part is removed from the first connector part, i.e. the connector parts are in a de-mated state, the spring, which may also be termed second spring, may push the piston out of the chamber, thus increasing the volume of the chamber and allowing the liquid to reenter the chamber. The damper unit may thus be available for performing a further controlled engagement of the first and second contacts in a subsequent mating process.

In an embodiment, the connector part has a forward end for engagement with the second connector part and a rearward end at which a connection, for example by means of a cable, or a hose, is provided. The damper unit comprises a damper body having a forward end and a rearward end, wherein the damper body includes a chamber that has an opening facing forwardly, i.e. that is open in the direction of the forward end of the connector part. The damper unit includes a first spring bearing on one side against the rearward end of the damper body and at the other side against a connector housing of the connector part (either directly or indirectly). In other words, the other side of the spring is stationary with respect to the connector housing, so that a force which it applies is transferred to the connector housing. A piston is arranged in the opening of the chamber of the damper body. The piston extends forwardly, i.e. in the direction of the forward end of the connector part. Furthermore, a second spring is arranged in the chamber and bears on one side against the piston and on the other side against a rearward wall of the chamber. The second spring urges the piston forwardly with respect to the damper body. An opening in the chamber allows a liquid to enter and escape the chamber. The first contact is mounted to the damper body. The piston is configured to be engaged by a shuttle pin of the connector part.

In such configuration, the damper body, to which the first contact is mounted, is movable relative to the connector housing and to the piston, which is engaged by the shuttle pin during mating. When the connector part and the second connector part are in the mated state, a pin of the second connector part may have entered the first connector part and may have pushed the shuttle pin rearwardly and into engagement with the piston. In the mated state, the pin, and as a result, the shuttle pin and the piston are stationary with respect to the connector housing. Accordingly, by allowing the damper body to move, the first contact may be moved out of the way during mating, and the engagement of the first contact with the second contact may be delayed efficiently.

The first spring may have a spring constant that is larger than the spring constant of the second spring. The first spring may thus be capable of moving the damper body against the force of the second spring.

At least part of said opening may be provided in the piston. As an example, the opening may comprise a flow channel through the piston. Furthermore, the opening may comprise a flow channel through the shuttle pin, so that when the shuttle pin is in engagement with the piston, the opening reaches through the piston and through the shuttle pin into a chamber of the connector housing. Additionally or alternatively, the opening may comprise an opening in the damper body.

In an embodiment, the damper body is a moveable element that has a first position in which the first contact engages the second contact when the connector part and the second connector part are in the mated state and a second position in which the first contact is spaced a part from the second connector part and the second connector part are in the mated state. In the unmated state of the connector part, the damper body may be in the first position, and the first and second springs may be in an extended state. In such position, since the second spring urges the piston out of the chamber, the chamber may have a relatively large volume (for example its maximum volume), and may thus be filled with the liquid.

Upon engagement of the connector part with the second connector part, the piston and the damper body may be urged rearwardly, thereby compressing the first spring and bringing the damper body into the second position. As the first contact is mounted to the damper body, the mating of the first contact with the second contact is prevented, as the damper body is brought into the second position. During the engagement, the second spring may only be compressed slightly, since the liquid filling the chamber in the damper body is only expelled slowly through the opening in the chamber, and thus provides a resistance to the compression of the second spring, i.e. to the piston being pushed into the chamber.

After the connector part and the second connector part have reached the mated state, the damper body may be urged forwardly by the first spring. Thereby, liquid may be expelled from within the chambers through the opening to damp the movement. In particular, since the piston is fixed in position due to its engagement with the shuttle pin that is held in place by the pin of the second connector part, movement of the damper body will cause the volume of the chamber to become smaller, thereby expelling the fluid from the chamber and compressing the second spring. Furthermore, the first contact may be moved into engagement with the second contact by the movement of the damper body. In particular, the first spring may move the damper body from the second position into the first position, thereby effecting the mating between the first and second contacts.

In the state in which the connector part is mated with the second connector part, and the first contact is engaged with the second contact, the second spring is generally in a compressed state. After disengagement (or de-mating) of the connector part and the second connector part, the second spring may urge the piston forwardly so as to increase the volume of the chamber. As the volume of the chamber is increased, liquid may enter the chamber through the opening. The initial unmated state of the connector part may thus be restored.

The connector may be a fiber optic connector. The first contact may comprise one or more optical contacts. The first contact may in particular comprise a fiber ferrule, such as a MT ferrule. Such ferrule may comprise plural optical fibers.

The connector part may have a housing that is at least partly filled with a liquid for pressure compensation. The damper unit may make use of this liquid to delay the engagement of the first contact with the second contact. Accordingly, the liquid may have a dual use, thus reducing the complexity of the connector part.

In another embodiment, the connector part is a connector part of an electrical connector, or a hybrid electrical and optical connector. The first contact may accordingly be an electrical contact, or may comprise an electrical contact and an optical contact.

According to a further embodiment of the present invention, a subsea wet-mateable connector comprising a connector part in any of the above outlined configurations is provided.

According to a further embodiment of the present invention, a method of providing a connection in a subsea environment by means of a connector part of a subsea connector is provided. The connector part comprises at least a first contact configured for engagement with a respective second contact of a second connector part. The method comprises the steps of engaging the first connector part with the second connector part; activating a damper unit during the engagement, wherein at least the first contact is mounted to the damper unit; delaying the engagement of the first contact with the second contact of the second connector part by means of the damper unit during engagement; and after the first connector part and the second connector part are in a mated state, bringing the first contact into engagement with the second contact by means of the damper unit to provide a connection.

By such method, advantages similar to the ones outlined further above may be achieved. Furthermore, the method may be performed by a connector part in any of the above outlined configurations.

In an embodiment of the method, the step of activating the damper unit during engagement may comprise urging a damper body of the damper unit rearwardly in a housing of the connector part against the force of a spring, thereby moving the first contact rearwardly. The steps of delaying the engagement of the first contact with the second contact and of bringing the first contact into engagement with the second contact may be performed by moving the damper body with the first contact forwardly by means of a spring force applied to the damper body by the spring. The damper unit is configured such that the forward movement of the damper body reduces the volume of a liquid filled chamber. Thereby, liquid may be expelled through an opening in the chamber. The movement of the damper body and thus the engagement of the first contact with the second contact may be delayed this way. Furthermore, by said movement, the first contact may be moved into engagement with the second contact, in particular at a speed that is controlled by said expelling of liquid through the opening in the chamber.

It should be clear that the method may comprise further steps, in particular steps that are outlined further above with respect to the connector part. Furthermore, the method may be performed with embodiments of the connector part in any of the configurations outlined herein.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

The forgoing and other features and advantages of the invention will become further apparent from the following detailed description read in conjunction with the accompanying drawings. In the drawings, like reference numerals refer to like elements.

DETAILED DESCRIPTION

Figure 1:
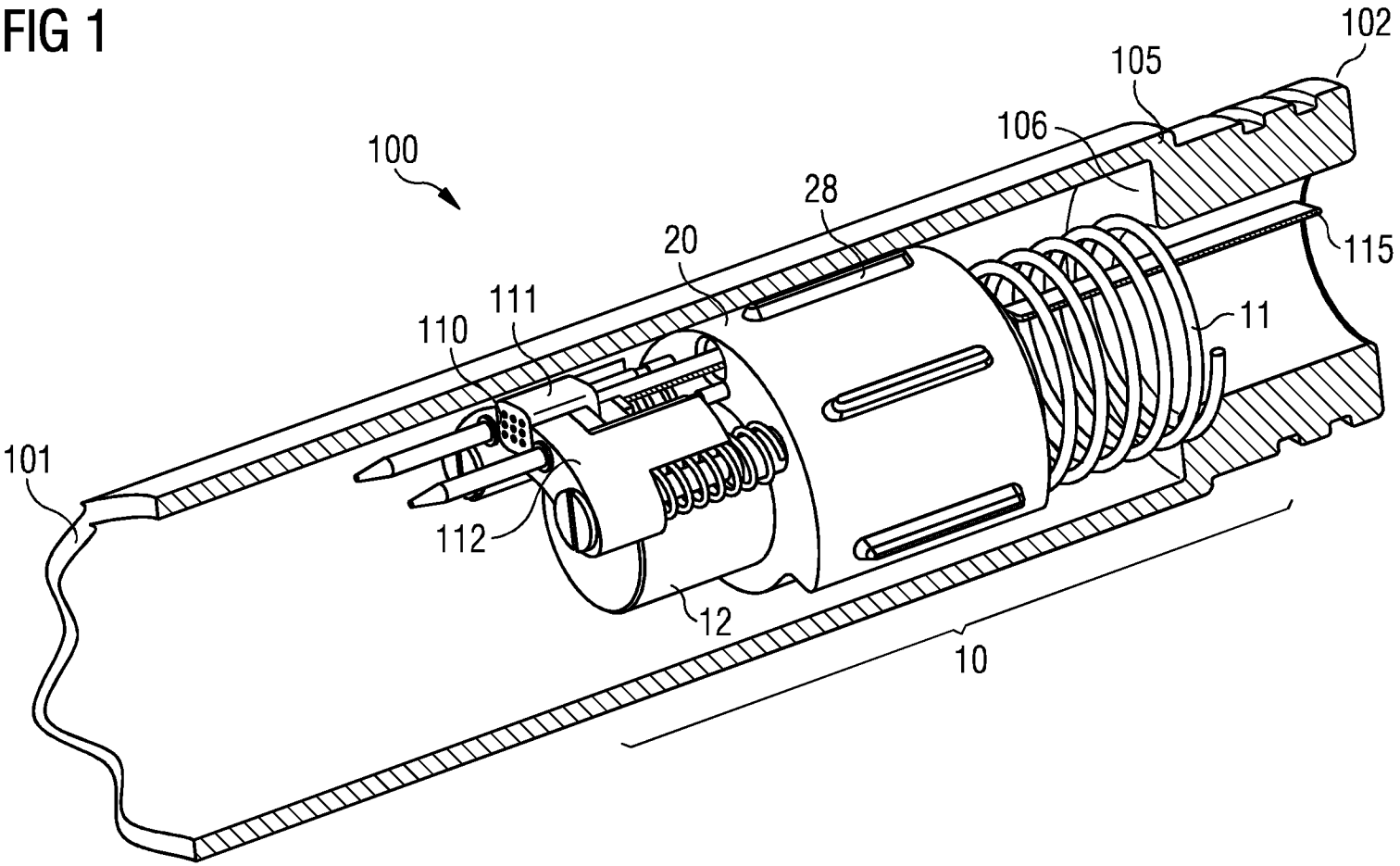
FIG. 1 is a schematic drawing showing a connector part according to an embodiment of the invention.

In the following, embodiments illustrated in the accompanying drawings are described in more detail. It should be clear that the following description is only illustrative and non restrictive. The drawings are only schematic representations, and elements in the drawings are not necessarily to scale with each other. In some embodiments, the elements illustrated in the drawings of FIGS. 1-6 may be to scale with each other as shown in these drawings.

FIG. 1 illustrates a connector part 100 according to an embodiment of the invention. The connector part 100 may also be termed first connector part. The connector part 100 includes the connector housing 105, which can be composed of multiple parts, although only a single part housing is shown for the purpose of illustration in FIG. 1. Furthermore, a contact 110 is provided for engagement with a corresponding second contact of a second connector part. The first and second connector parts are part of a wet mateable subsea connector and are configured to be mated under water.

In the example of FIG. 1, the first contact 110 is provided by a ferrule 111 that includes plural optical fibers that are led into the connector by means of the connection 115, which is for example a fiber optic cable. The subsequent description is based on a fiber optic connector employing a fiber ferrule 111 as an example. Nevertheless, it should be clear that embodiments of the inventions may also be used with other types of contacts 110, for example a single optical contact, or an electrical contact, or a hybrid contact comprising electrical and optical contacts. Connection 115 may thus accordingly being optical line, an electrical line, or two lines, for example optical and electrical line may be provided.

The connector part 100 comprises a damper unit 10. The damper unit 10 is provided for delaying the engagement of the first contact 110 with the second contact when the connector part 100 is mated with the second connector part. In particular, the damper unit 10 moves the contact 110 out of the way, i.e. away from the first position illustrated in FIG. 1, so that upon mating of the connector part 100 with the second connector part, the contact 110 does not engage the second contact. Furthermore, the damper unit 10 is configured to subsequently move the contact 110 into engagement with the second contact at a controlled speed. This way, the engagement speed of the first contact 110 and the second contact can be decoupled from the mating speed of the connector part 100 with the second connector part.

Note that FIG. 1 only shows a fraction of the connector part 100. The connector part 100 has a forward end 101 at which the second connector part engages the first connector part. It further has rearward end 102, where the connector part 100 is for example connected to a cable, i.e. it may comprise a cable termination, or may be mounted to a stab plate or an enclosure wall or the like. The connector part extends along an axial direction between the forward end 101 and the rearward end 102.

The damper unit 10 includes a damper body 20 and a spring 11. The spring 11 bears on one side against a rearward end of the damper body 20, and at its other side against the connector housing 105 of connector part 100. As an example, it may bear against a shoulder 106 of the housing 105. It should be clear that in other configurations, it may also bear against another part of the housing, either directly or indirectly, e.g. via another component that is mounted to the housing 105, so that the force applied by the spring is transferred to the housing 105.

The damper unit 10 furthermore includes the piston 12 that is moveable into the damper body 20. The contact 110 is mounted to the damper body 20. The damper body 20 is moveable along the axial direction together with the contact 110, which is explained in more detail further below. As shown in FIG. 1, the contact 110 does not need to be fixedly mounted to the damper body 20. Rather, the contact 110 may include further elements that ensure a smooth engagement of the first contact 110 with the second contact. In the present example, these include pins and springs so that a certain compliance is provided. Furthermore, the mount for the contact 110 includes guide pins which guide the contact 110 and the second contact into the engaged position. By providing a certain degree of flexibility, it can be ensured that the first and second contacts are properly aligned. Nevertheless, it can be seen from FIG. 1 that if the damper body 20 is moved, the contact 110, together with its mount, moves together with the damper body 20.

The damper unit 10, or at least parts of it, are provided in a chamber of the housing 105 that is filled with a fluid, in particular a liquid, such as a dielectric liquid. As an example, the chamber may be oil filled. At the front of the housing 105, the connector part 100 may be sealed against the outside environment, for example by making use of a shuttle pin that is sealed inside an opening. Furthermore, pressure compensation elements, such as bellows, flexible membranes or the like may be provided for pressure compensating the interior, in particular the liquid filling the housing 105, of the connector part 100 against the outside environment.

An example of a possible configuration of the subsea connector including a pin and a shuttle pin is for example described for an optical connector in the document U.S. Pat. No. 6,929,404 B2, the contents of which is incorporated herein by reference in its entirety. For an electrical connector, such configuration is for example described in the document U.S. Pat. No. 6,659,780 B2, the contents of which is incorporated herein by reference in its entirety.

The damper body 20 includes guide elements 28, such as ridges shown in FIG. 1, which allow the damper body 20 to be guided along the inside of the housing 105. In particular, the damper body 20 can slide along the inside of the housing while liquid that is displaced during the movement of the damper body can pass between the inner surface of the housing 105 and the damper body 20, since the ridges cause a certain spacing between the damper body and the housing.

Figure 2:
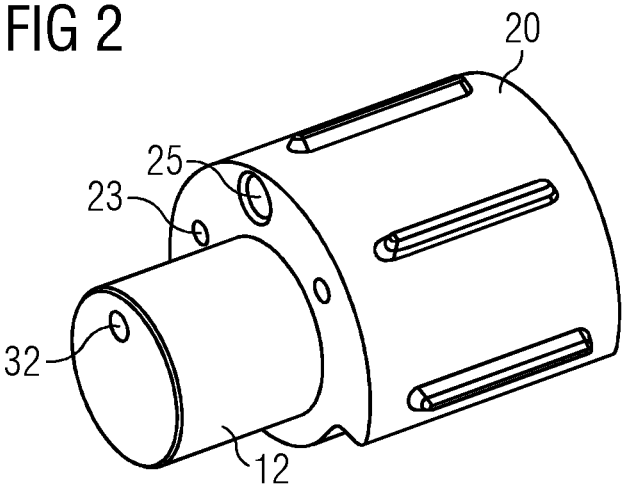
FIG. 2 is a schematic drawing showing a perspective view of a part of a damper unit of the connector part of FIG. 1.

FIG. 2 is a schematic drawing showing the damper body 20 and the piston 12 in more detail. The damper body 20 includes a through hole 25 through which the connection, for example the electrical and/or fiber optical connection for contacting the first contact 110 can be let. Furthermore, mounting holes 23 are provided for mounting the first contact 110 to the damper body 20, in particular by means of the mount 112 shown in FIG. 1.

Figure 3:
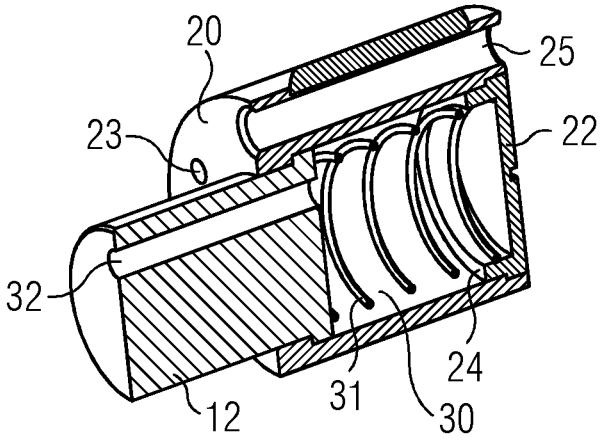
FIG. 3 is a schematic drawing showing a sectional perspective view of the part of the damper unit of FIG. 2.

In FIG. 3, which is a sectional perspective view of a part of the damper unit 10, the interior of the damper body 20 can be seen. Inside the damper body 20, a chamber 30 is provided. The piston 12 can move into the chamber 30 against the force of a spring 31 that urges the piston towards its extended position that is illustrated in FIG. 3. Spring 31 bears on one side against the rearward wall 22 of damper body 20 and on its other side against the piston 12. As can be seen, the piston 12 is at its rearward end provided with a protrusion so that it cannot be separated from the damper body 20. Furthermore, the chamber 30 includes an opening 32 that in the present example is provided in form of a flow channel through the piston 12. It should be clear that in other configurations, the opening 32 may be provided at different positions, for example in form of an opening or aperture in the damper body 20.

In the configuration of FIG. 3, the damper body 20 can be moved relative to the piston 12. If such movement occurs, a fluid, in particular a liquid filling the chamber 30 is expelled through the opening 32, since the volume of chamber 30 is reduced. Since the opening 32 constitutes a flow restriction, movement of the piston 12 into the damper body 20 is damped. The time required by the piston 12 to fully move into a final position in which it abuts the abutment face 24 inside a chamber 30 is determined by the amount of force applied to the piston 12 or to the damper body 20, and the dimension of the opening 32, as well as the viscosity of the fluid or liquid filling the chamber 30. Accordingly, it is possible to adjust the speed with which the damper body 20 moves relative to the piston 12 by adjusting any of these parameters.

In consequence, since the damper body 20 is allowed to move relative to the housing 105, the speed of movement of the damper body 20 and thus of the first contact 110 mounted thereto can be adjusted by these parameters. Accordingly, the engagement speed of the first contact 110 with the second contact can be adjusted.

Figure 4:
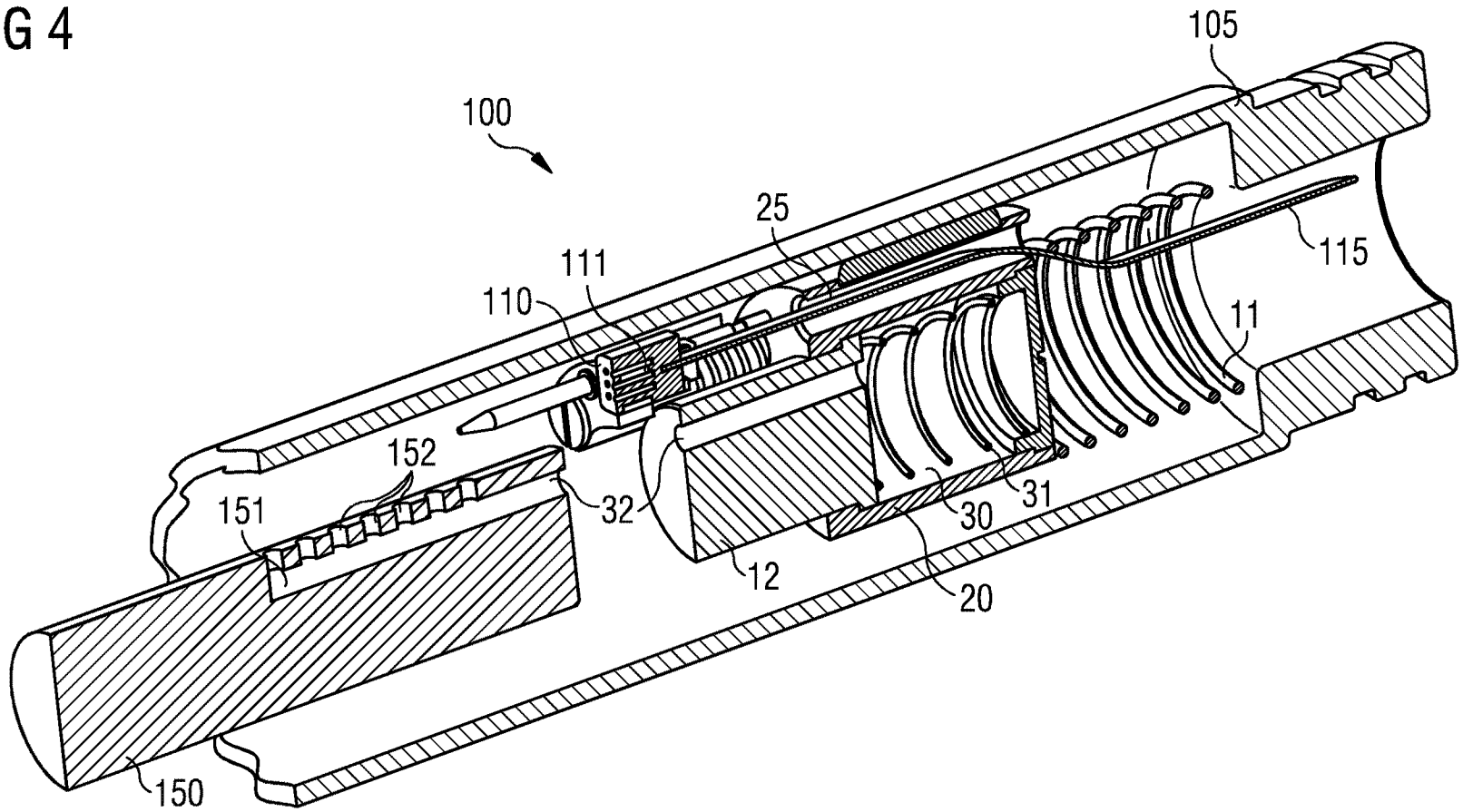
FIG. 4 is a schematic drawing showing a sectional perspective view of the connector part of FIG. 1 in a de-mated state.

FIG. 4 shows the connector part 100 of FIG. 1 in the unmated state in a perspective sectional view. In the unmated state, the first spring 11 pushes the damper body 20 forwardly into a first position. Accordingly, also the contact 110 is located in a first position. Furthermore, the second spring 31 inside the damper body 20 pushes the piston 12 forwardly, the spring 31 being in an extended state. In this state, liquid fills the chamber 30.

FIG. 4 furthermore illustrates a shuttle pin 150 of the first connector part 100. As outlined above, such shuttle pin may for example seal an opening in the housing 105 of the first connector part 100, and may be pushed backwardly during mating of the first connector part 100 with the second connector part, for example by a pin of the second connector part that enters the opening and the chamber within the housing 105.

The shuttle pin 150 furthermore includes in the example of FIG. 4 a flow channel 151 and apertures 152. Flow channel 151 provides a flow connection together with the flow channel in the piston 12 when the shuttle pin 150 engages the piston 12. Accordingly, the flow channel 151 and the apertures 152 may form part of the opening 32 of the chamber 30. In other words, liquid may flow into and out of the chamber 30 through the opening 32, including the flow channel 151 and the apertures 152.

Figure 5:
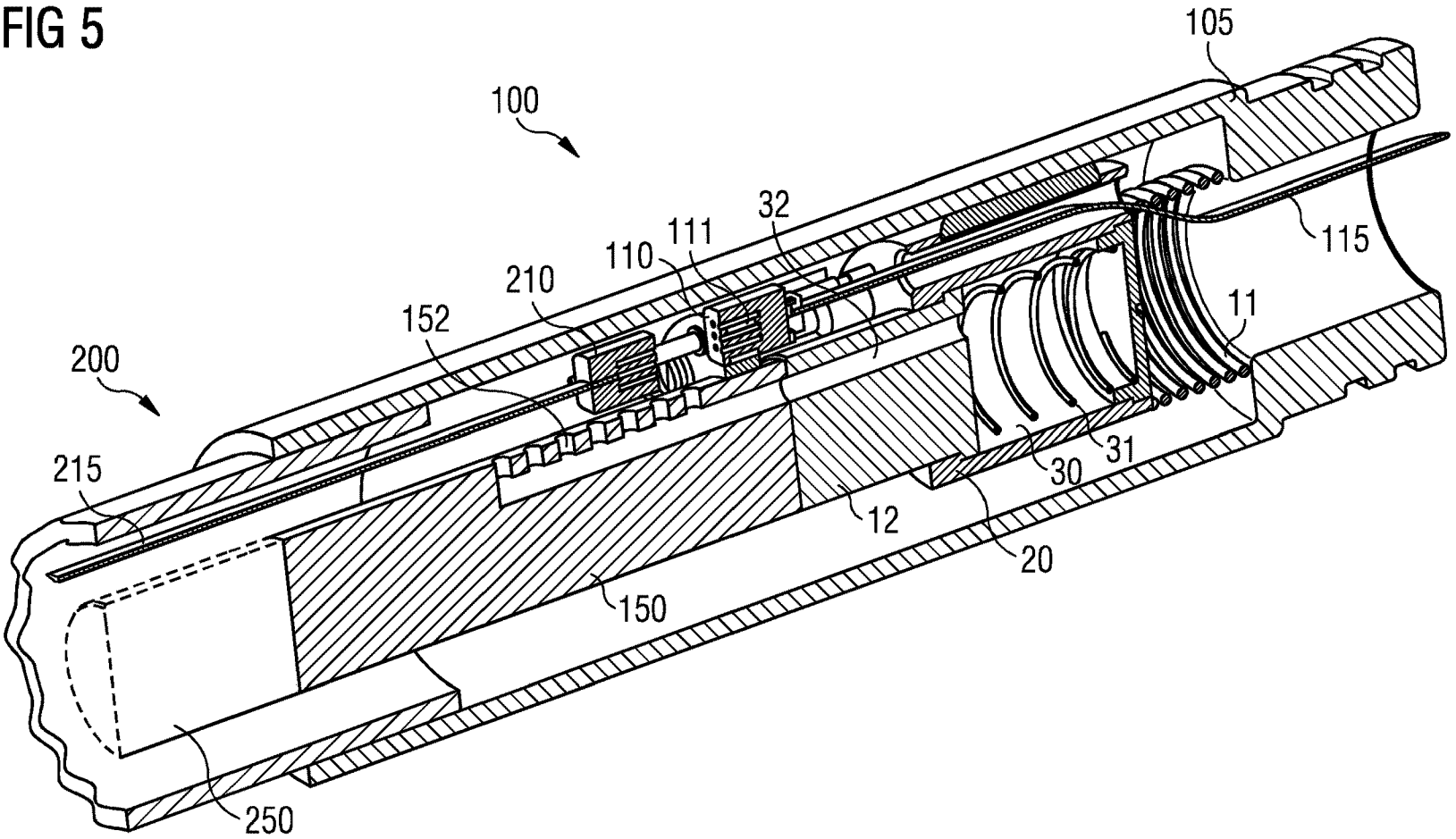
FIG. 5 is a schematic drawing showing a sectional perspective view of the connector part of FIG. 1 in a state in which the connector part is mated with a second connector part and in which the first contact is spaced apart from the second contact.

In FIG. 5, the connector part 100 is illustrated in a state in which the connector part 100 is mated with a second connector part 200, i.e. the connector parts 100 and 200 are in a mated state. Nevertheless, the state illustrated in FIG. 5 is a state that is reached directly after the first connector part 100 is mated with the second connector part 200 and the first contact 110 is not yet in engagement with the second contact 210. During mating, the pin 250 of the second connector part 200 pushes the shuttle pin 150 rearwardly in the connector housing 105 and into engagement with the piston 12.

Upon further progress of the mating, the piston 12 together with the damper body 20 are pushed rearwardly against the force of the first spring 11. Due to the restriction of the flow of liquid out of the chamber 30, the piston 12 remains in the extended state and does not compress the spring 31. Although it should be clear that as soon as the shuttle pin 150 applies a force to the piston 12 in a rearward direction, the applied force will lead to liquid flowing through the opening 32 out of the chamber 30, so that compression of the spring 31 and movement of the piston 12 into the chamber 30 starts. Nevertheless, the movement is relatively slow so that there is no significant compression of the spring 31 when the first and second connector parts 100, 200 reach the mated state.

By the force applied by the pin 250 to the shuttle pin 150 that is transferred to the piston 12, the piston 12 together with the damper body 20 moves rearwardly. This movement continues until the first and second connector parts 100, 200 have reached the mated state, which is shown in FIG. 5. In the situation illustrated in FIG. 5, the compressed first spring 11 now applies a force to the damper body 20 in a forward direction. Damper body 20 is thus urged forwardly, wherein the forward movement is restricted by the volume of liquid that can leave the chamber 30 through the opening 32. Accordingly, the speed of movement of the damper body 20 in forward direction can be controlled by controlling the volume of liquid that is allowed to leave the chamber 30. As outlined above, this can be achieved by controlling for example the size and number of apertures 152, by controlling the dimensions of the flow channel, by controlling the viscosity of the liquid, by controlling the spring constant of spring 11 or the like.

In the state illustrated in FIG. 5, the damper body 20 is moved into a second, rearward position. The first contact 110 mounted to the damper body 20 is thus also moved into a second, rearward position. In the second position of contact 110, the contact 110 is spaced apart from the second contact to 210, as shown in FIG. 5. Accordingly, the first and second contacts 110, 210 are not in engagement, and no connection is established.

When the damper body 20 is no moved forwardly by the force applied by spring 11, the first contact 110 is also moved forwardly and thus back into the first position. Accordingly, contact 110 is moved into engagement with the second contact 210. This occurs at controlled speed, since the speed of the damper body 20 is controlled as outlined above. The present embodiment thus allows the engagement of the first and second contacts 110, 210 at controlled speed.

Figure 6:
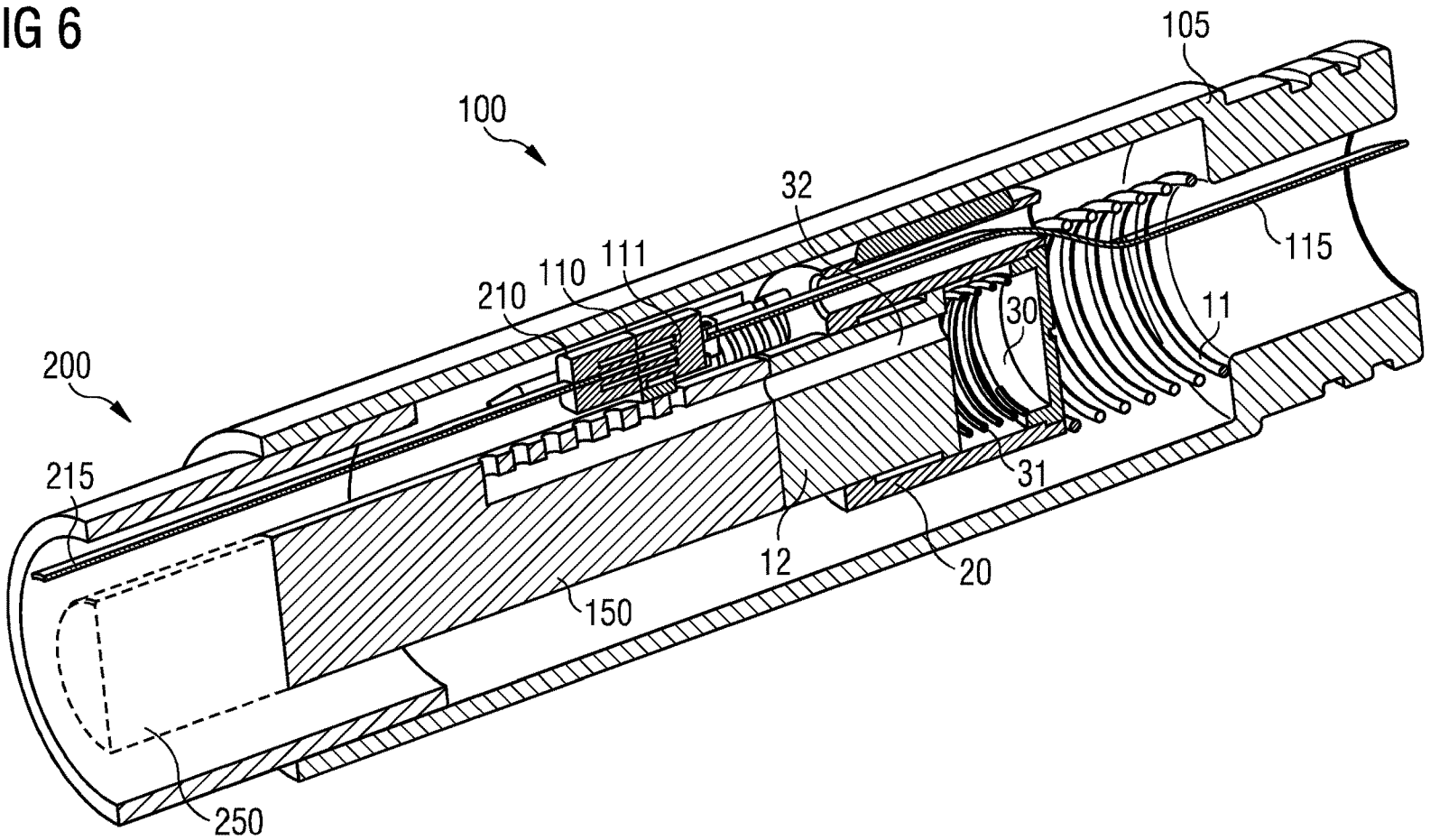
FIG. 6 is a schematic drawing showing a sectional perspective view of the connector part of FIG. 1 in a state in which the connector part is mated with a second connector part and in which the first contact is in engagement with the second contact.

FIG. 6 shows the connector part 100 of FIG. 5 in the mated state and in a state in which the first and second contacts 110, 210 are in engagement. As can be seen, the first spring 11 is now extended, whereas the second spring 31 is now compressed. The damper body 20 and thus the first contact 110 are now located in the first position. The first and second contacts 110, 210 are in engagement and establish a connection between the line 115 and the line 215 of the first and second connector parts 100, 200, respectively. A data connection or a connection for power transfer may thus be established. Preferably, it is a fiber optical data connection that is being established.

The subsea connector with the mated first and second connector parts 100, 200 can now remain in operation for the desired amount of time. If the connector parts are de-mated again, the first connector part 100 is moved rearwardly with respect to the second connector part 200. Accordingly, the shuttle pin 150 will move forwardly and will return into its position in the de-mated state where it seals an opening in the housing 105 of the first connector part 100. As a consequence, the piston 12 is free to move again, and will be urged forwardly by the compressed spring 31. Accordingly, liquid can flow into the chamber 30 through the opening 32. Finally, the piston 11 will reach its extended state, and the connector part 100 will thus return to the state that is illustrated in FIG. 4.

As can be seen, embodiments of the inventions provide decoupling between the mating speed of the first and second connector parts 100, 200 and the engagement speed of the first contact 110 with the second contact 210. Since the first contact 110 is moved rearwardly during the mating process, damage to the first or second contact 110, 210 may be prevented. Furthermore, engagement of the first and second contacts 110, 210 can occur at controlled speed. It should be clear that the configuration shown in FIGS. 1 to 6 is only exemplary, and that the same principles can be applied in other configurations of the connector part or the damper unit. As an example, the contact 110 may in other embodiments be mounted to the piston 12, or the chamber 30 may be formed between a damper body and the housing 105 or the like.

Figure 7:
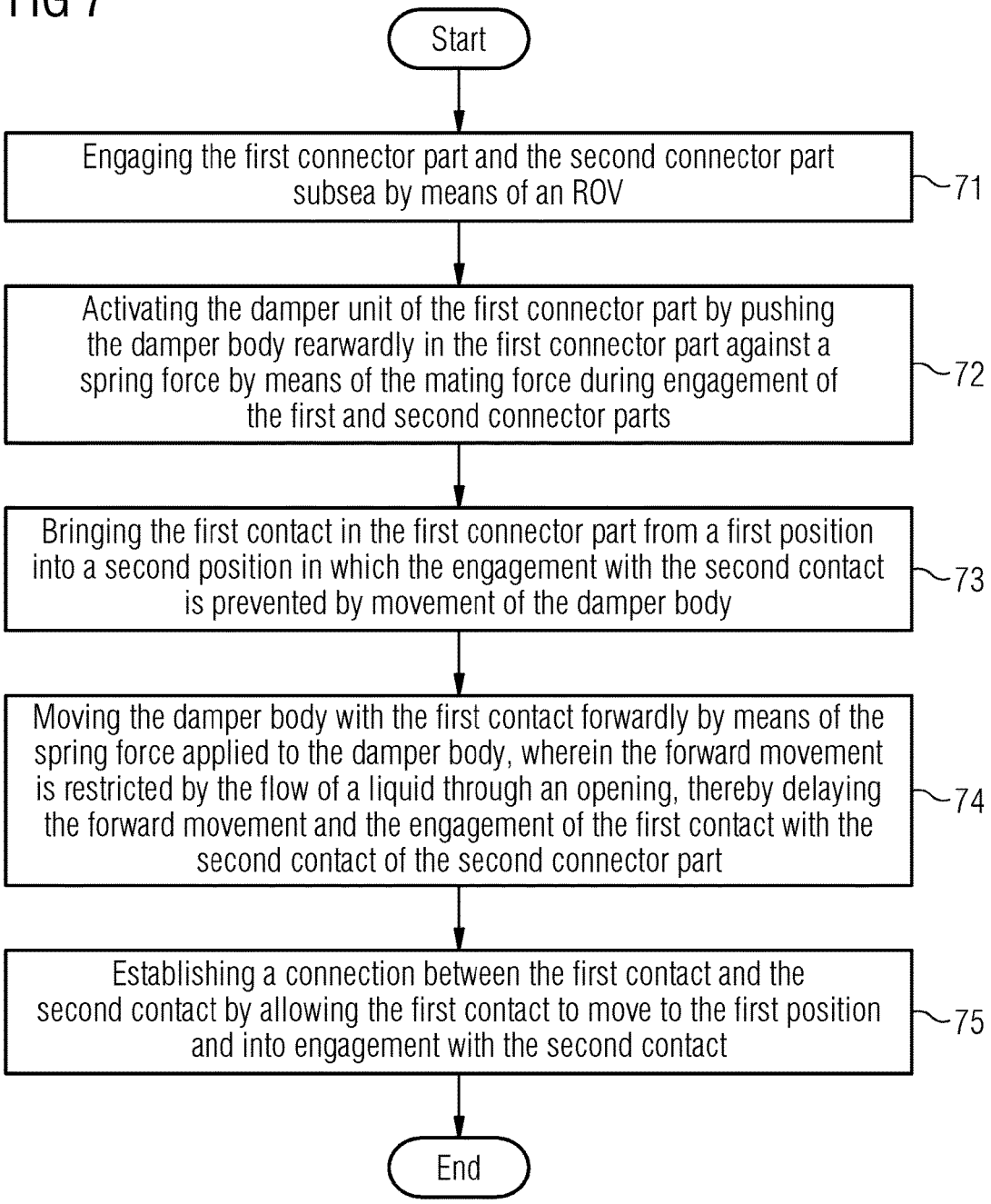
FIG. 7 is a flow diagram illustrating a method according to an embodiment of the invention.

FIG. 7 is a flow diagram illustrating a method according to an embodiment of the invention. In step 71, the first connector part 100 and the second connector part 200 are engaged subsea by means of an ROV. As outlined further above, such mating of the connector parts by an ROV generally occurs under the control of an ROV pilot, and can thus generally occur at different mating speeds. In particular, in certain situation, excessive mating speeds may be reached.

In step 72, the damper unit 10 of the first connector part 100 is activated by pushing the damper body 20 rearwardly in the first connector part 100 against a spring force. The force required for pushing the damper body rearwardly is provided by the mating force during the mating of the first and second connector parts. Accordingly, there is no need for any actively driven movement of any of the components, such as by means of an electric motor or the like.

By the movement of the damper body, the first contact in the first connector part is brought from a first position into a second position in which the engagement with the second contact is prevented (step 73). In particular, the first contact is moved rearwardly in the connector housing of the first connector part, whereby damage to the first and/or second contact may be prevented during the mating.

In step 74, the damper body with the first contact is moved forwardly by means of the force applied by the compressed spring to the damper body. The forward movement is restricted by the flow of liquid through an opening, whereby the forward movement of the first contact is delayed. Accordingly, the engagement of the first contact with the second contact of the second connector part is delayed. In particular, the engagement occurs at controlled speed.

The first contact is allowed to move back to the first position and into engagement with the second contact. Thereby, a connection is established between the first contact and the second contact (step 75). Accordingly, a connection between the first contact and the second contact can be established in a reliable and controlled way.

In summary, regardless of the ROV pilot's performance with respect to his ability of controlling the mating speed, the internal damping unit in the first connector part allows an independent engagement of the first and second contacts. The performance of the internal mating process is thus managed by the damping unit. The negative effects that an inadvertent high speed mate may have in conventional connectors may thus be mitigated or even be avoided.

As a consequence, a connector failure may be prevented. In particular, such damage to a contact may cause latent failure and may go undetected for a certain period of time. By preventing such damage, reliability of the subsea system may accordingly be improved.

While specific embodiments are disclosed herein, various changes and modifications can be made without departing from the scope of the invention. The embodiments described herein are to be considered in all respects as illustrative and non-restrictive, and any changes coming within the meaning and equivalency range of the appended claims are intended to be embraced therein.

What is claimed is:

1. A connector part of a subsea connector adapted to be mated with a second part of the subsea connector, wherein the connector part comprises:

at least a first contact configured for engagement with a respective second contact of the second connector part for establishing a connection, and a damper unit, wherein at least the first contact is mounted to the damper unit, wherein the damper unit is configured to be activated by a mating of the connector part with the second connector part and is further configured to delay the engagement of said first contact with the second contact of the second connector part during the mating of the connector part with the second connector part.

2. The connector part according to claim 1, wherein the damper unit is configured to delay the engagement of the first contact with the second contact such that at the point in time when the connector part and the second connector part reach a mated state, the first contact is not yet in engagement with the second contact, and wherein the damper unit is configured to move the first contact into engagement with the second contact after the connector part and the second connector part have reached the mated state.

3. The connector part according to claim 1, wherein the damper unit is configured to delay the engagement of said first contact with the second contact with a time constant that is determined by a flow of fluid through a restriction.

4. The connector part according to claim 1, wherein the damper unit comprises a movable element to which the first contact is mounted, wherein the movable element is movable between a first position in which the first contact engages the second contact when the connector part and the second connector part are in the mated state, and a second position in which the first contact is spaced apart from the second contact when the connector part and the second connector part are in the mated state.

5. The connector part according to claim 4, wherein when the connector part is in an unmated state, the movable element is located at the first position, and wherein during the mating of the connector part with the second connector part, the movable element is moved into the second position.

6. The connector part according to claim 4, wherein the movement of the movable element is effected by a mating force applied to the connector part or the second connector part during mating, and/or wherein the movement of the movable element is effected by an elastic force or a spring force.

7. The connector part according to claim 4, wherein the damper unit further comprises a spring that is mechanically connected to the movable element so as to urge the movable element into the first position.

8. The connector part according to claim 7, wherein a movement of the movable element from the second position into the first position is effected by said spring, wherein the damper unit is configured such that said movement displaces a liquid at a predetermined rate, said displacement of liquid damping said movement and delaying said engagement of the first contact with the second contact.

9. The connector part according to claim 4, wherein said movable element is a damper body.

10. The connector part according to claim 1, wherein said damper unit comprises a damper body defining a chamber and further comprises a piston providing a wall of the chamber, wherein the piston is movable relative to the damper body to change the volume of the chamber, wherein the chamber is filled with a liquid and comprises an opening through which the liquid can enter and escape the chamber, wherein the first contact is mounted to the piston or the damper body, and wherein the delay in the engagement of the first contact with the second contact at least partly results from the time required to expel liquid from within said chamber through said opening when moving the damper body relative to the piston.

11. The connector part according to claim 10, wherein said chamber comprises a spring that applies a force to the piston that pushes the piston in a direction in which the volume of the chamber is increased.

12. The connector part according to claim 1, wherein the connector part has a forward end for mating with the second connector part and a rearward end at which a connection is provided, wherein the damper unit comprises:

a damper body having a forward end and a rearward end, wherein the damper body includes a chamber that has an opening facing forwardly, a first spring bearing on one side against the rearward end of the damper body and at the other side against a connector housing of the connector part, a piston arranged in the opening of the chamber of the damper body, the piston extending forwardly, a second spring arranged in the chamber and bearing on one side against said piston and on the other side against a rearward wall of the chamber, the second spring urging the piston forwardly with respect to the damper body, and an opening in the chamber enabling a liquid to enter and escape the chamber, wherein said first contact is mounted to the damper body and wherein said piston is configured to be engaged by a shuttle pin of the connector part.

13. The connector part according to claim 12, wherein the damper body is a movable element that has a first position in which the first contact engages the second contact when the connector part and the second connector part are in the mated state and a second position in which the first contact is spaced apart from the second contact when the connector part and the second connector part are in the mated state, wherein the damper unit is configured such that in the unmated state of the connector part, the damper body is in the first position and the first and second springs are in an extended state, and that upon mating of the connector part with the second connector part, the piston and the damper body are urged rearwardly, thereby compressing the first spring and bringing the damper body into the second position, whereby mating of the first contact with the second contact is prevented, and that after the connector part and the second connector part have reached the mated state, the damper body is urged forwardly by said first spring, thereby expelling liquid from within said chamber through said opening to dampen the movement, wherein the first contact is moved into engagement with the second contact.

14. A method of providing a connection in a subsea environment by means of a connector part of a subsea connector, wherein the connector part comprises at least a first contact configured for engagement with a respective second contact of a second connector part, wherein the method comprises:

engaging the first connector part with the second connector part, activating a damper unit during the engagement, wherein at least the first contact is mounted to the damper unit, delaying the engagement of the first contact with the second contact of the second connector part by means of the damper unit during the engagement, after the first connector part and the second connector part are in a mated state, bringing the first contact into engagement with the second contact by means of the damper unit to provide the connection.

15. The method according to claim 14, wherein the step of activating the damper unit during engagement comprises urging a damper body of the damper unit rearwardly in a housing of the connector part against the force of a spring, thereby moving the first contact rearwardly, and wherein the steps of delaying the engagement of the first contact with the second contact and of bringing the first contact into engagement with the second contact are performed by moving the damper body with the first contact forwardly by means of a spring force applied to the damper body by said spring, wherein the damper unit is configured such that the forward movement of the damper body reduces the volume of a liquid filled chamber, thereby expelling the liquid through an opening in the chamber, whereby the movement of the damper body and thus the engagement of the first contact with the second contact are delayed, and wherein the first contact is moved into engagement with the second contact.

16. The connector part according to claim 3, wherein the restriction comprises an aperture.

17. The connector part according to claim 6, wherein the movement of the movable element from the first position to the second position is effected by a mating force applied to the connector part or the second connector part during mating, and/or wherein the movement of the movable element from the second position to the first position is effected by an elastic force or a spring force.

* * * * *